US009550552B2

(12) United States Patent
Dyhrberg

(10) Patent No.: US 9,550,552 B2
(45) Date of Patent: Jan. 24, 2017

(54) MARINE CLEANING SYSTEM

(71) Applicant: GRD Franmarine Holdings Pty Ltd, Henderson, WA (AU)

(72) Inventor: Roger Wayne Richard Dyhrberg, North Fremantle (AU)

(73) Assignee: GRD FRANMARINE HOLDINGS PTY LTD, Henderson, WA (AU)

( * ) Notice: Subject to any disclaimer, the term of this patent is extended or adjusted under 35 U.S.C. 154(b) by 0 days.

(21) Appl. No.: 14/913,803

(22) PCT Filed: Sep. 4, 2013

(86) PCT No.: PCT/AU2013/001007
§ 371 (c)(1),
(2) Date: Feb. 23, 2016

(87) PCT Pub. No.: WO2015/031933
PCT Pub. Date: Mar. 12, 2015

(65) Prior Publication Data

US 2016/0207597 A1 Jul. 21, 2016

(51) Int. Cl.
*B63B 59/08* (2006.01)

(52) U.S. Cl.
CPC ..... *B63B 59/08* (2013.01); *B63B 2059/082* (2013.01)

(58) Field of Classification Search
CPC ..... B63B 59/08
See application file for complete search history.

(56) References Cited

U.S. PATENT DOCUMENTS

| | | | |
|---|---|---|---|
| 3,628,489 | A | 12/1971 | Michaelsen |
| 7,971,547 | B1 | 7/2011 | Hertel |
| 8,327,787 | B2 | 12/2012 | Achord |

FOREIGN PATENT DOCUMENTS

| | | |
|---|---|---|
| AU | 2012244227 | 5/2013 |
| EP | 0 131 987 | 1/1985 |
| EP | 0 275 605 | 7/1988 |
| WO | WO 2009/142506 | 11/2009 |

OTHER PUBLICATIONS

PCT/AU2013/001007 International Search Report dated Oct. 30, 2013 (3 pages).

*Primary Examiner* — Stephen Avila
(74) *Attorney, Agent, or Firm* — Brinks Gilson & Lione; G. Peter Nichols

(57) ABSTRACT

A cleaning head for cleaning a submerged surface includes a body portion, and a skirt portion extending around a periphery of the body portion, the skirt portion performing a sealing function between the body portion and a submerged surface desired to be cleaned when the cleaning head is disposed on the submerged surface during use. The cleaning head also includes at least one cleaning member for causing material on the submerged surface to separate from the submerged surface when the cleaning head is disposed on the submerged surface during use, and at least one suction aperture in fluid communication with a space defined between the body portion and the submerged surface during use.

22 Claims, 8 Drawing Sheets

MARINE CLEANING SYSTEM

This application claims priority to International Application No. PCT/AU2013/001007 filed Sep. 4, 2013, the entire contents of which is incorporated herein by reference.

FIELD OF THE INVENTION

The invention relates to a marine cleaning system, in particular for cleaning an underwater portion of a vessel hull or other structure.

BACKGROUND OF THE INVENTION

It is known that a tendency exists for an underwater portion of a vessel hull or structure to become increasingly fouled over time to the extent that eventually a significant layer of material, including in some circumstances living organisms, accumulates on the underwater portion of the vessel hull or structure.

If such fouling is not removed from the vessel hull or structure, significant problems can occur, including damage to the vessel hull or structure and, in the case of a marine vessel, a reduction in seafaring performance of the vessel. In addition, some living organisms can be noxious and, if transported to other locations, can be dangerous to local species.

Uncontrolled in-water cleaning can release chemical and biological contaminants into the local environment, and for example may stimulate the release of reproductive propagules, or plant and animal fragments capable of regeneration.

In order to avoid release of such contaminants into the local marine environment, conventional vessel hull cleaning techniques have involved removing the vessel from the water, and subsequently cleaning the vessel hull. However, this approach is expensive and time consuming.

SUMMARY OF THE INVENTION

In accordance with a first aspect of the present invention, there is provided a cleaning system for cleaning a submerged surface, the cleaning system comprising:

- a cleaning head having:
  - a body portion;
  - a skirt portion extending around a periphery of the body portion, the skirt portion performing a sealing function between the body portion and a submerged surface desired to be cleaned when the cleaning head is disposed on the submerged surface during use; and
  - at least one cleaning member for causing material on the submerged surface to separate from the submerged surface when the cleaning head is disposed on the submerged surface during use;
- a device for generating a negative pressure; and
- a suction pipe extending between said device and the cleaning head, the suction pipe being in fluid communication with a space defined between the body portion and the submerged surface during use;
- wherein during use when the cleaning head is disposed on the submerged surface, material separated from the submerged surface is drawn away from the cleaning head through the suction pipe.

In an embodiment, the body portion comprises a plurality of body portion sections moveably connected together.

In an embodiment, the body portion comprises first and second body portions moveably connected together.

In an embodiment, the first and second body portions are moveably connected together using a hinge.

In an embodiment, the skirt portion is of bristle like configuration.

In an embodiment, the cleaning head comprises a height adjustment system arranged to facilitate adjustment of the distance between the body portion and the submerged surface to be cleaned, and thereby adjustment of the degree of compression of the skirt portion during use, and adjustment of the efficacy of the seal formed between the skirt portion and the submerged surface.

In an embodiment, the cleaning head comprises a drive mechanism arranged to urge the cleaning head to move relative to the submerged surface during use.

In an embodiment, the drive mechanism comprises at least 2 drive shafts connected together at a universal joint, each drive shaft having a drive wheel mounted on the drive shaft.

In an embodiment, the height adjustment system is arranged to facilitate adjustment of the distance between one or more of the drive shafts and the body portion.

In an embodiment, the drive mechanism comprises a hydraulic motor, and a flow control device arranged to facilitate control of the amount of fluid supplied to the hydraulic motor and thereby the speed of movement of the cleaning head.

In an embodiment, the cleaning head comprises a plurality of cleaning members.

In an embodiment, at least one cleaning member comprises a rotatable brush.

In an embodiment, at least one cleaning member comprises a rotatable blade arranged to scrape material from the submerged surface during use.

In an embodiment, at least one cleaning member comprises at least one cleaning element arranged to generate a fluid current adjacent the submerged surface when the cleaning element moves relative to the submerged surface during use, the fluid current causing material to be released from the submerged surface.

In an embodiment, at least one cleaning element includes a foot portion disposed at a first side of the cleaning element facing towards the direction of movement of the cleaning element during use, and a cut out portion disposed at a second side of the cleaning element facing away from the direction of movement of the cleaning element during use.

In an embodiment, the foot portion is substantially wedge shaped.

In an embodiment, the wedge shape tapers at an angle of approximately 45°.

In an embodiment, the shape of the cut out portion is substantially the same as the shape of the foot portion.

In an embodiment, each cleaning element is arranged to rotate such that the cut out portion follows the rotational path defined by the foot portion.

In an embodiment, the cleaning head comprises at least one motor arranged to cause the or each cleaning member to rotate.

In an embodiment, the at least one motor comprises at least one hydraulic motor.

In an embodiment, the cleaning head comprises at least one rotatable disc portion, each disc portion including at least one cleaning element.

In an embodiment, the cleaning head comprises at least one buoyancy member.

In an embodiment, the cleaning head comprises a device for reducing pressure at the cleaning head in a region between the cleaning head and a submerged surface during use.

In an embodiment, the device for reducing pressure at the cleaning head is arranged to reduce pressure at a location substantially centrally of the cleaning member.

In an embodiment, the device for reducing pressure comprises an impeller.

In an embodiment, the motor is arranged to effect rotation of the impeller.

In an embodiment, the cleaning head comprises a housing arranged to rotatably receive the impeller, the housing including a housing skirt portion arranged to perform a sealing function between the housing and the submerged surface desired to be cleaned when the cleaning head is disposed on the submerged surface during use.

In an embodiment, the impeller comprises a hollow raised section having alternately circumferentially disposed wall portions and wall apertures, and at least one impeller blade extending outwardly of a respective wall portion, the hollow raised section defining an impeller aperture in fluid communication with the wall apertures, wherein rotation of the impeller causes a reduction in pressure in the hollow raised section.

In an embodiment, the disc portion includes a central aperture and the hollow raised section is disposed adjacent and in fluid communication with the central aperture.

In an embodiment, the impeller is resiliently connected to the cleaning member.

In an embodiment, the cleaning head comprises a safety mechanism arranged to cease operation of the cleaning head if an operator becomes incapacitated or is otherwise unable to operate the cleaning head.

In accordance with a second aspect of the present invention, there is provided a cleaning system for cleaning a submerged surface, the cleaning system comprising:

- a cleaning head according to the first aspect of the invention;
- a device for generating a negative pressure; and
- a suction pipe extending between said device and the cleaning head, the suction pipe being in fluid communication with a space defined between the body portion and the submerged surface during use;
- wherein during use when the cleaning head is disposed on the submerged surface, material separated from the submerged surface is drawn away from the cleaning head through the suction pipe.

In an embodiment, the device for generating a negative pressure comprises a suction pump.

In an embodiment, the cleaning system comprises an auxiliary cleaning head connectable to the suction pump and manually operable by an operator.

In an embodiment, the system comprises a separation device arranged to receive a slurry of water and material separated from the submerged surface and to separate the water and material from the slurry.

In an embodiment, the system comprises a disinfection device arranged to substantially disinfect water that has been separated from the slurry.

In an embodiment, the system comprises a cleaning enclosure including at least one transparent wall portion, at least one aperture, a sealing device associated with each aperture, and a suction aperture in fluid communication with a space defined by the enclosure, wherein a cleaning device is disposable through the aperture and the sealing device such that the cleaning device forms a substantially sealed relationship with the aperture.

In accordance with a third aspect of the present invention, there is provided method of cleaning a submerged surface, the method comprising:

- providing a cleaning head having:
  - a body portion;
  - a skirt portion extending around a periphery of the body portion; and
  - at least one cleaning member for causing material on the submerged surface to separate from the submerged surface when the cleaning head is disposed on the submerged surface;
- disposing the cleaning head on the submerged surface such that the skirt portion contacts the submerged surface and performs a sealing function between the body portion and the submerged surface;
- connecting a space defined between the body portion and the submerged surface in fluid communication with a device for generating a negative pressure;
- activating said device and the at least one cleaning member so that material is separated from the submerged surface and is drawn away from the cleaning head.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
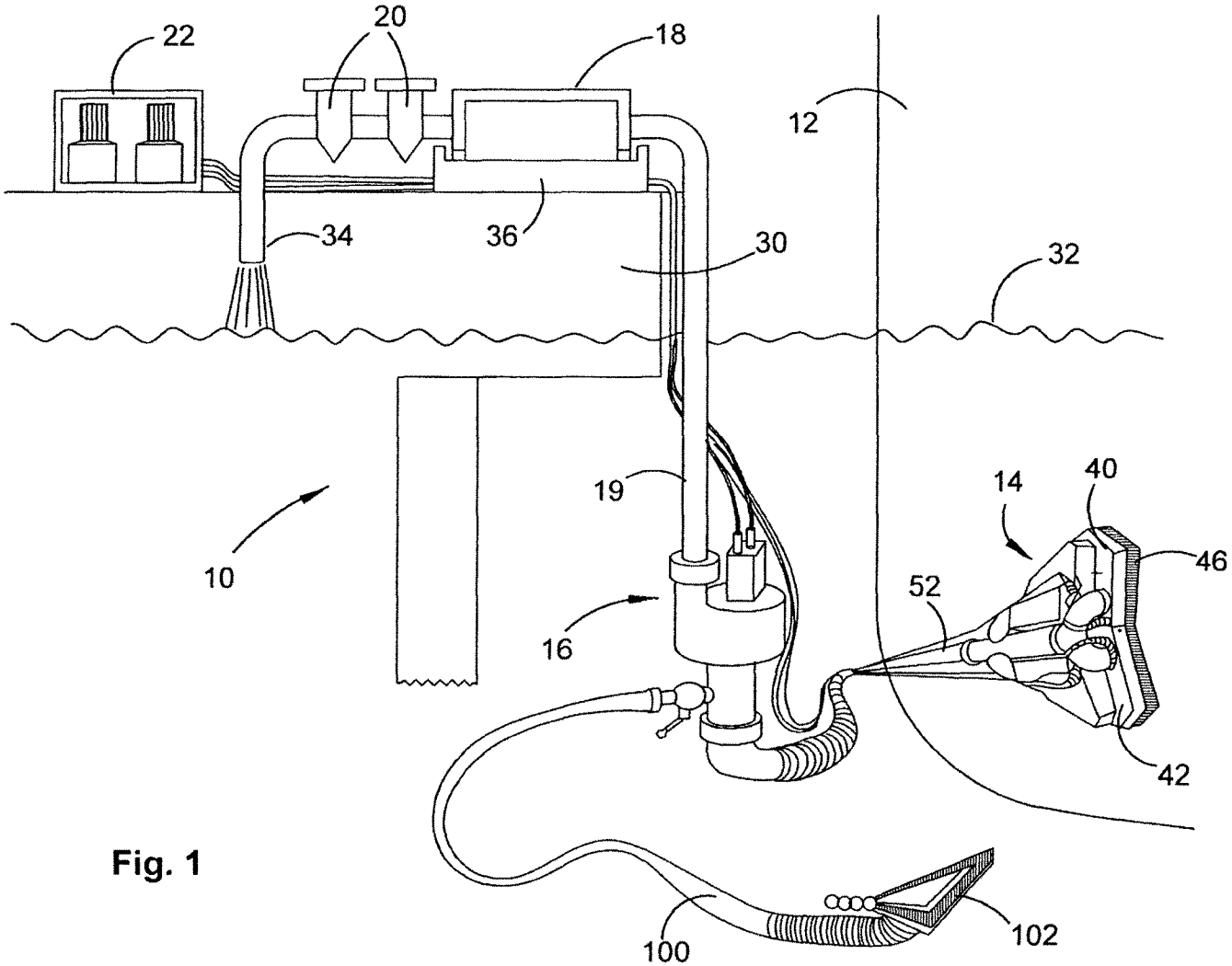
FIG. 1 is a diagrammatic representation of a marine cleaning system in accordance with an embodiment of the present invention.

Referring to the drawings, in FIG. 1 there is shown a marine cleaning system 10 for cleaning a submerged portion of a vessel or other structure in situ.

The present embodiment is described in relation to cleaning a vessel hull, although it will be understood that other applications are envisaged.

The system 10 includes a cleaning head 14, in this example arranged during use to be disposed on an underwater portion of a vessel hull 12 and configured so as to separate fouling material from the vessel hull 12.

The system 10 also includes a device for generating a negative pressure in a space defined between the cleaning head 14 and the vessel hull 12 so that material that is separated from the vessel hull by the cleaning head 14 is discouraged from passing into the surrounding marine environment and instead is drawn away from the cleaning head 14. In this example, the device for generating negative pressure is a conventional suction pump 16 of the type configured to operate in a marine environment. The suction pump 16 may be hydraulically or electrically powered.

In a marine environment, the fouling material present on a vessel hull 12 is typically predominantly of biological type, although other types of material may also be present.

The system 10 also includes a separation device 18 arranged to receive a slurry of water and material separated from the vessel 12 and to separate the water and material from each other, and a disinfection device 20 arranged to substantially disinfect the water that has been separated from the material.

It will be understood that the separation device 18 and the disinfection device 20 may take any suitable form, and in this example the separation device 18 is of a type manufactured by Baleen Filters Pty Ltd, for example a B1010S Baleen filter, and the disinfection device is of a type manufactured by Berson Milieutechniek BV, for example a Berson inline 450 UV disinfection device. The disinfection device may in addition or alternatively include a chemical based disinfection component. Flow meters and other volume measuring devices may also be included in order to improve water treatment quality.

The system 10 also includes a power unit 22 arranged to provide components of the system with the required electrical and/or hydraulic power.

In this example, the separation device 18, the disinfection device 20 and the power unit 22 are disposed above the waterline 32, for example on a jetty 30, and the suction pump 16 is disposed below the waterline 32.

During use, the cleaning head 14 is disposed adjacent a portion of the vessel hull 12 desired to be cleaned and the suction pump 16 is activated so that a slurry containing water and material separated from the vessel hull 12 by the cleaning head 14 is drawn away from the cleaning head 14 and caused to move up to the separation device 18 through an extraction conduit 19. At the separation device 18, solid material separated from the slurry collects in a solids collection bin 36 and water filtered from the slurry passes through the disinfection device 20 and back to the surrounding marine environment through an outlet pipe 34.

While the present example is described in relation to a vessel hull 12, it will be understood that the system is applicable to any structure having a part which is submerged and therefore susceptible to fouling. It will also be understood that while the present example is described in relation to cleaning bio-fouling from a vessel hull or submerged structure, the system is also applicable to cleaning other types of fouling that may build up on structures submerged under water, or indeed in other fluid environments, for prolonged periods of time.

Figure 2:
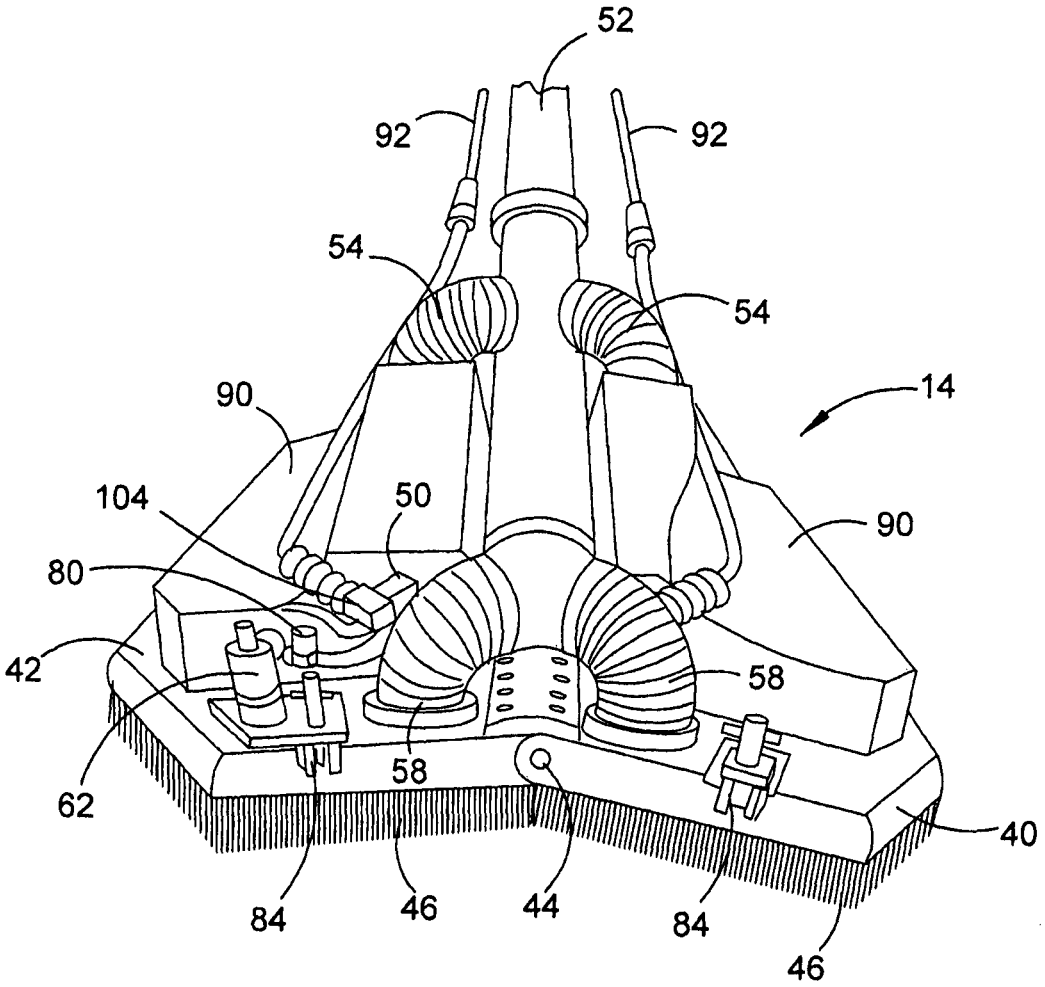
FIG. 2 is a diagrammatic upper perspective view of a cleaning head in accordance with an embodiment of the present invention.
Figure 3:
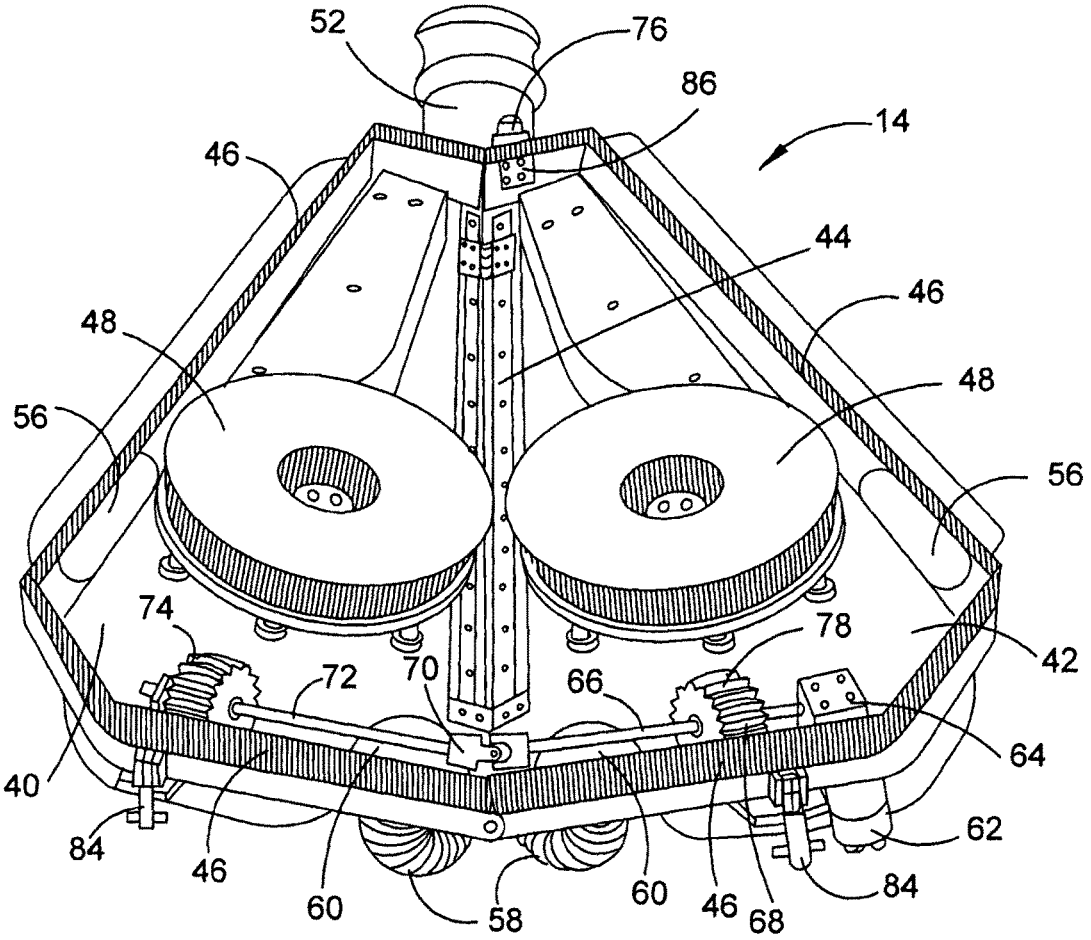
FIG. 3 is a diagrammatic lower perspective view of the cleaning head shown in FIG. 2.
Figure 4:
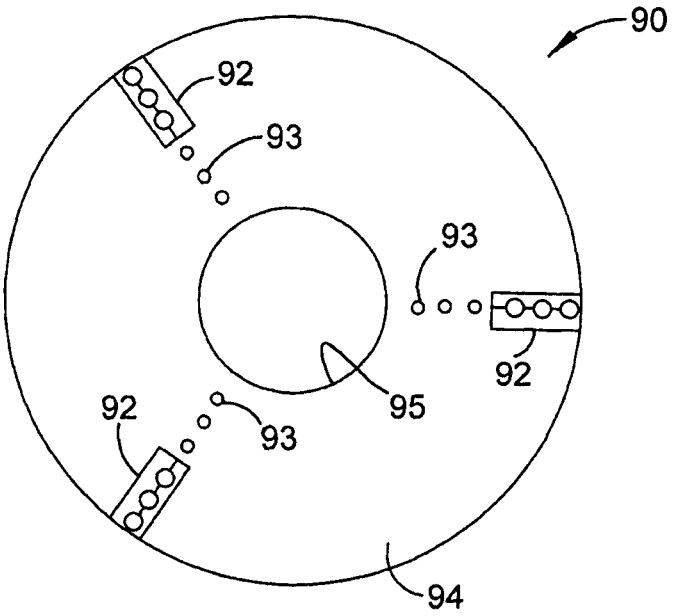
FIG. 4 is a diagrammatic plan view of an alternative cleaning member of an alternative embodiment of a marine cleaning system.
Figure 5:
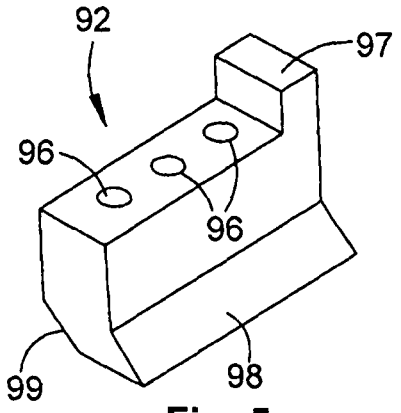
FIGS. 5 to 8 are diagrammatic perspective, side, top and bottom views of a cleaning element of the cleaning member shown in FIG. 4.

Referring to FIGS. 2 and 3, the cleaning head 14 is shown in more detail.

The cleaning head 14 in this example includes first and second body portions 40, 42 that are moveably connected to each other so that the profile defined by the first and second body portions 40, 42 is adjustable. In this example, the first and second body portions 40, 42 are connected to each other by a hinge 44 that enables the first and second body portions 40, 42 to pivot relative to each other. This enables the first and second body portions 40, 42 to generally conform to the curvature of a structure such as a vessel hull 12.

A periphery defined by the first and second body portions 40, 42 is provided with a skirt portion 46, in this example of bristle like configuration. The purpose of the skirt portion 46 is to provide a seal of sufficient efficacy between the first and second body portions 40, 42 and a surface of a structure intended to be cleaned. In this regard, the seal should be sufficiently efficacious that the negative pressure generated by the suction pump 16 causes material separated from the surface to be drawn away from the surface through the cleaning head 14 with minimal egression of material past the skirt portion 46 to the surrounding marine environment. This is important because biological material separated from the surface of the vessel hull 12 has the potential to cause undesirable consequences to the surrounding environment.

As shown more particularly in FIG. 3, the cleaning head 14 includes one or more cleaning members arranged to cause material on the surface of the vessel 12 to separate from the surface. In this example, two counter rotating cleaning members are provided and each cleaning member is in the form of a rotatable brush 48.

In this example, the brushes 48 are caused to rotate by at least one first hydraulic motor 50, although it will be understood that other arrangements for causing rotation of the brushes 48 are envisaged. In this example, 2 first hydraulic motors 50 are provided, with each rotatable brush having an associated first hydraulic motor 50.

The cleaning head 14 also includes a suction pipe 52 that extends from the cleaning head 14 to the suction pump 16. The suction pipe 52 conveys the slurry of water and material separated from the surface away from the cleaning head 14 during use. Extending from the suction pipe 52 are first suction conduits 54 in communication with the suction pipe 52 and extending to respective first suction apertures 56 disposed at opposite sides of the cleaning head 14. Also extending from the suction pipe 52 are second suction conduits 58 in communication with the suction pipe 52 and extending to respective second suction apertures 60 disposed at an end of the cleaning head 14 remote from the suction pipe 52. In this example, the first and second suction apertures 56, 60 are disposed adjacent the rotatable brushes 48.

In an example, the first hydraulic motors(s) 50 may include a pump assembly arranged to increase efficiency in the cleaning head by pushing the slurry of water and material separated from the surface towards the suction apertures 56, 60.

In this example, the cleaning head 14 also includes a drive mechanism arranged to urge the cleaning head to move in a direction parallel to the hinge 44 during use. In this example, the drive mechanism includes a second hydraulic motor 62 connected to a reduction gearbox 64 and arranged to drive movement of the cleaning head 14.

The drive mechanism includes a first drive shaft 66 connected to the reduction gearbox 64 and a first drive wheel 68 mounted on the first drive shaft 66. The first drive shaft 66 is connected through a universal joint 70 to a second drive shaft 72, and a second drive wheel 74 is mounted on the second drive shaft 72.

Since the first and second drive shafts 66, 72 are connected together through the universal joint 70, rotation of the first drive shaft 66 causes rotation of the second drive shaft 72 and thereby rotation of the first and second drive wheels 68, 74. During use, when the first and second drive wheels 68, 74 rotate, contact between the first and second drive wheels 68, 74 and the surface being cleaned causes the cleaning head 14 to move in a direction generally parallel to the hinge 44.

It will be understood that the universal joint 70 ensures that the drive mechanism is able to cause the cleaning head 14 to move for a wide range of angles between the first and second body portions 40, 42.

A non-driven rear wheel 76 is also provided.

The wheels 68, 74, 76 may be of any suitable configuration, and in this example each wheel comprises a wheel body and metal wire 78 wound around the wheel body.

In this example, the cleaning head 14 also includes a flow control device 80 arranged to control the flow of hydraulic fluid to the second hydraulic motor 62 and thereby the speed of rotation of the second hydraulic motor 62, the speed of rotation of the first and second drive wheels 68, 74 and the speed of movement of the cleaning head 14.

The first and second hydraulic motors 50, 62 are supplied with hydraulic fluid through hydraulic conduits 92 that extend from the first and second hydraulic motors 50, 62 to the power unit 22 disposed above the waterline 32.

In an example, the hydraulic power may be derived from a salt water hydraulic power system arranged to provide pressurised salt water to the first and second hydraulic motors 50, 62. This arrangement has advantages in that a return line is not required.

In this example, the cleaning head 14 also includes first and second height adjustment devices 84, 86 arranged to facilitate adjustment of the distance between the first and second body portions 40, 42 and the surface to be cleaned. The height adjustment devices 84, 86 facilitate modification of the position of the drive wheels 68, 74 and the non-driven wheel 75 relative to the first and second body portions 40, 42. In this way, the degree of compression of the skirt portion 46 during use is adjustable, and as a consequence the efficacy of the seal formed between the skirt portion 46 and the surface being cleaned is adjustable. The effect of this is that the pressure differential between the surrounding marine environment and the space defined by the cleaning head 14 and the surface being cleaned is adjustable as required, and therefore the amount of water passing into the space defined by the cleaning head 14 and the surface is controllable.

In this example, the cleaning head 14 also includes buoyancy members 90 that assist the cleaning head to remain in contact with the surface to be cleaned.

The system 10 may also include an auxiliary cleaning head 100 connectable to the suction pump 16 and usable by an operator to manually clean material from a surface. Such an auxiliary cleaning head 100 may include a skirt portion 102 of similar configuration to the skirt portion 46 of the cleaning head 14, may provide a negative pressure region adjacent the surface to be cleaned, and may or may not include cleaning members that actively remove material from the surface.

The system 10 may also include a safety mechanism 104 configured such that positive input from an operator is required in order to activate the rotatable brushes 48 and/or the drive mechanism. In the absence of such positive input, operation of the rotatable brushes 48 and/or the drive mechanism ceases. The safety mechanism may be of a type conventionally referred to as a 'dead man's control' wherein operation ceases if the operator is incapacitated or otherwise unable to operate the cleaning head 14.

During operation, an operator places the cleaning head 14 adjacent a surface to be cleaned such that the skirt portion 46 contacts the surface, and activates the system so that the brushes 48 begin to rotate and a negative pressure is generated in the space defined by the first and second body portions 40, 42 and the surface to be cleaned. As material is separated from the surface by the brushes 48, the material becomes entrained in surrounding water and a slurry containing the water and separated material is sucked through the suction pipe 52 by the suction pump 16 up to the separation device 18, in this example disposed on the jetty 30. The separation device receives the slurry, separates water from the slurry and feeds the separated water into the disinfection device 20. Solid material separated from the slurry passes into a solids collection bin 36, and water passing through the disinfection device 20 is disinfected and recycled back to the marine environment through the outlet pipe 34.

It will be appreciated that the cleaning system enables an operator to substantially clean material from a submerged surface, in particular a surface of a vessel hull 12, in situ, because substantially all of the material removed from the surface is transported away from the surface without leeching into the surrounding water. Removal of the vessel from the water in order to effect cleaning is not necessary.

In a variation of the above embodiment, in addition to or instead of the rotatable brushes 48, the cleaning members may include one or more rotatable cleaning elements arranged to scrape material from the surface to be treated during use.

In a further variation of the above embodiment, in addition to or instead of the rotatable brushes 48, the cleaning members may include one or more cleaning elements arranged to generate a fluid current adjacent the surface to be treated that causes material to be released from the surface during use substantially without touching the surface.

For example, in FIGS. 4 to 8 an alternative cleaning member 90 that includes a plurality of cleaning elements 92 is shown. The cleaning elements 92 in this example are removably disposed on a rotatable disc portion 94, in this example by engaging bolts with fixing apertures 93 provided on the disc portion 94.

In this example, the cleaning member 90 is arranged such that suction may be applied directly to a location between the cleaning member and a surface to be cleaned during use, and for this purpose the disc portion 94 includes a central aperture 95 through which suction may be applied during use.

Figure 8:
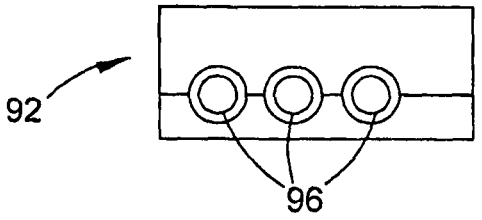
Figure 9:
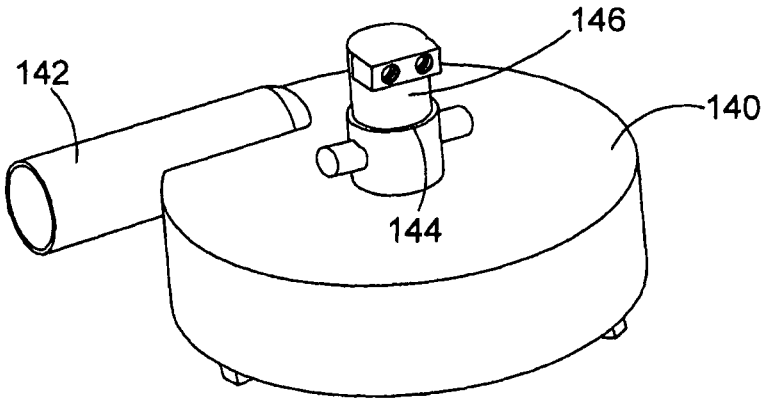
FIG. 9 is a diagrammatic upper perspective view of a housing of a cleaning head in accordance with an alternative embodiment of the present invention.
Figure 10:
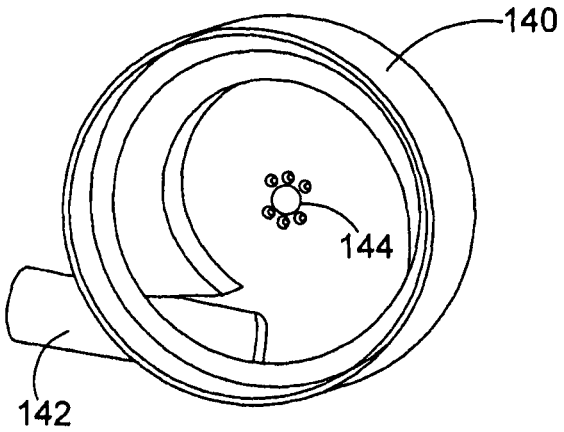
FIG. 10 is a diagrammatic lower perspective view of the housing shown in FIG. 9.

A cleaning element 92 is shown more particularly in FIGS. 5 to 8. The cleaning element 92 in this example includes fixing apertures 96 that facilitate fixing of the cleaning element to the disc portion 94, the fixing apertures 96 being recessed on an upper side of the cleaning element, as shown in FIG. 8.

In this example, the cleaning element 92 includes a key portion 97 that engages with a corresponding recess or aperture in the disc portion 94.

Figure 6:
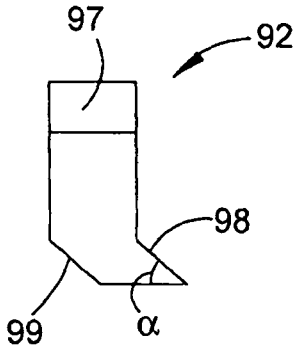
Figure 7:
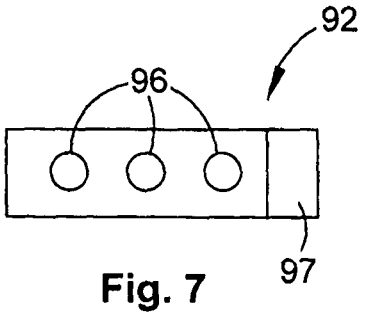

The cleaning element 92 also includes a foot portion 98 extending outwardly and that, in this example, defines a wedge shaped portion that tapers at an angle $\alpha$ shown in FIG. 6 of approximately 45°. At an opposite side of the cleaning element to the foot portion 98 is a cut out portion 99 that in this example defines a space of approximately the same shape and size as the foot portion 98.

The cleaning elements 92 are disposed on the disc portion 94 and the disc portion is disposed and moved during use such that as the disc portion 94 rotates the cut out portion 99 follows the rotational path defined by the foot portion 98, and the foot and cut out portions 98, 99 move relative to a surface to be treated with the foot and cut out portions 98, 99 closely adjacent and spaced from the surface. Without wishing to be bound by theory, it is believed that this arrangement causes a positive pressure region to be produced adjacent the foot portion 98 and a negative pressure region to be produced adjacent the cut out portion 99, and this in turn causes a fluid vortex effect adjacent the surface that causes material disposed on the surface to be removed.

It will be understood that the alternative cleaning member 90 enables material to be removed from a surface to be treated substantially without touching the surface, and this may be particularly useful in situations wherein contact with the surface is likely to cause damage, or in situations wherein the surface is coated with a substance such as silicone or copper oxide that is desired to be maintained on the surface or that would be toxic if removed.

In this example, the cleaning elements 92 are formed of nylon material, although it will be understood that any suitable material is envisaged.

An alternative embodiment of a cleaning head 88 incorporating the alternative cleaning member 90 is shown in FIGS. 9 to 13. Like and similar features are indicated with like reference numerals.

In this example, each cleaning member 90 is rotatably mounted in a housing 140, as shown more particularly in FIGS. 9 to 12. Each housing 140 includes a fluid outlet pipe 142 in fluid communication with the suction pump 16 and a drive aperture 144 arranged to rotatably receive a drive shaft 146.

Each drive shaft 146 is connected to a pressure imparting device arranged to produce a region of reduced pressure centrally of the housing 140. In this example, the pressure imparting device includes an impeller 148.

The impeller 148 in this example includes a disc portion 150 integral with a hollow central raised section 152 provided with alternate wall portions 154 and apertures 156. The impeller 148 also includes externally disposed blades 158 that serve to move fluid as the impeller 148 rotates, and a central aperture 159 defined by the central raised section 152 and in fluid communication with the apertures 156.

The impeller 148 is connected to the disc portion 94 through resilient members 160, in this example springs, that serve to allow the disc portion 94 and thereby the cleaning member 90 to resiliently move relative to the impeller 148. The central aperture 159 of the impeller 148 and the central aperture 95 of the disc portion 94 substantially align when the disc portion 94 and the impeller 148 are connected together.

Figure 11:
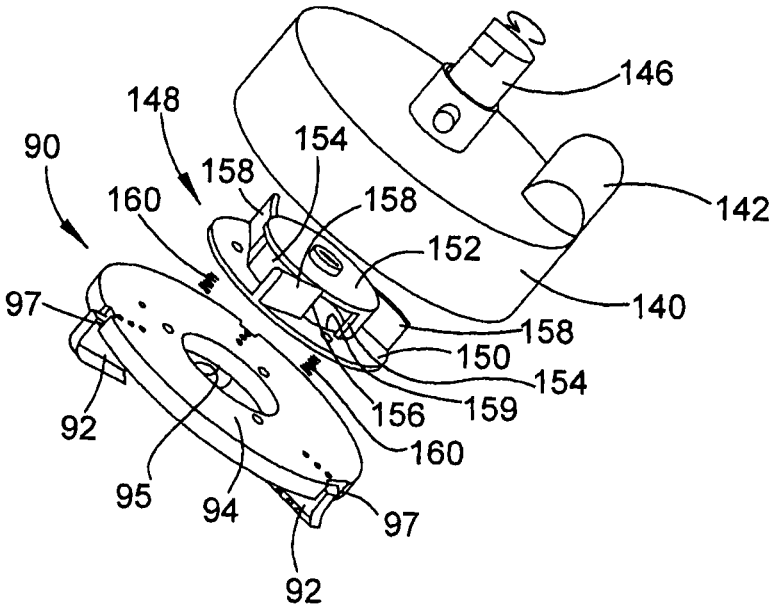
FIG. 11 is a diagrammatic exploded perspective view of a cleaning member assembly of the cleaning head in accordance with an alternative embodiment of the present invention.
Figure 12:
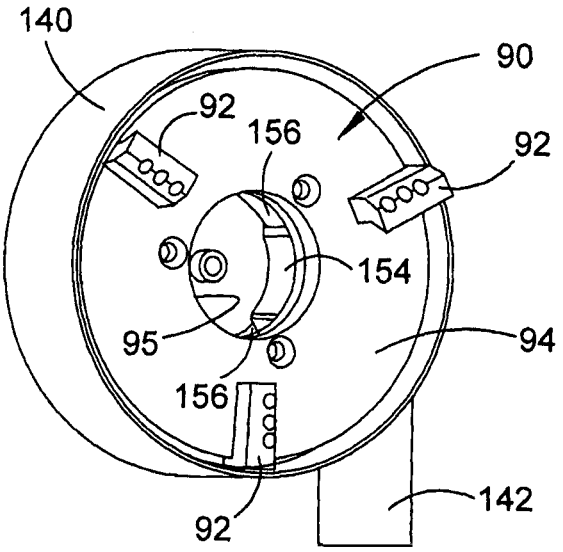
FIG. 12 is a diagrammatic perspective view of the cleaning member assembly shown in FIG. 11.

During use, the drive shaft 146 is caused to rotate by a first hydraulic motor 50, in this example in an anti-clockwise direction indicated in FIG. 11, which causes the impeller 148 to rotate and thereby generate a negative pressure region inside the central raised section 152 of the impeller 148. At the same time, the cleaning member 90 also rotates thereby causing material to be removed from a surface adjacent the cleaning elements 92.

It will be understood that the negative pressure region at the central raised section 152 of the impeller 148 causes material removed from the surface to be drawn into the impeller 148 and through the apertures 156 in the impeller 148 to the fluid outlet pipe 142.

In this way, in addition to the negative pressure generated between the cleaning member 90 and the surface to be cleaned by the suction pump 16, a negative pressure is also generated by the action of the impeller 148 which enhances the suction force applied to the slurry adjacent the cleaning member 90.

It will also be understood that generating a negative pressure at the cleaning head in addition to generating a negative pressure using a remote suction pump enables lighter and less expensive conduit to be used between the suction pump 16 and the cleaning head 14, 88.

Figure 13:
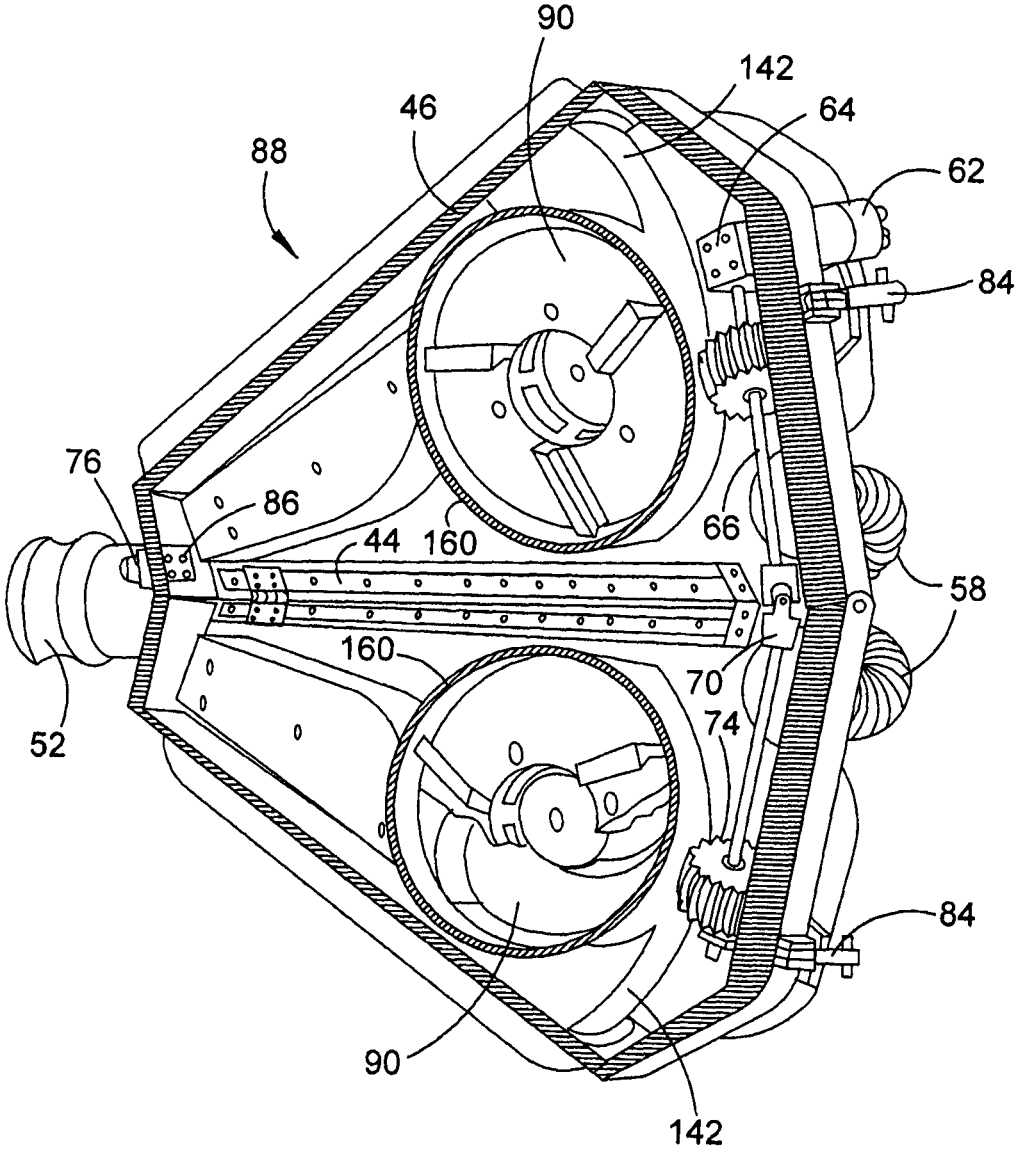
FIG. 13 is a diagrammatic lower perspective view of the alternative cleaning head.

As shown in FIG. 13, the alternative cleaning head 88 in this example includes 2 alternative cleaning members 90, each mounted in a respective housing 140. The alternative cleaning members 90 and associated drive motors are arranged so that the cleaning members 90 counter rotate during use.

In this example, the circumferential wall 160 of each housing is provided with a skirt portion, in this example of bristle like configuration, the purpose of which is to improve a seal with the surface 12 of the structure intended to be cleaned.

It will be appreciated that during use the alternative cleaning head 88 provides a first chamber defined by each housing 140 and the surface 12 to be cleaned, and a second chamber defined with the surface 12 to be cleaned that encloses the first chamber. This configuration provides dual protection against egress of material from the cleaning head 88 to the surrounding water during use.

While the alternative cleaning head 88 is described in relation to a cleaning member 90 provided with cleaning elements 92, it will be understood that features of the alternative cleaning head 88 may be incorporated into the cleaning head 14 shown in FIGS. 2 and 3 where appropriate. For example, the cleaning head 14 may incorporate an arrangement for generating negative pressure at the cleaning head 14, for example using an impeller configuration of the type shown in FIGS. 9 to 13 to generate suction generally centrally of the rotatable brushes 48.

The cleaning system 10 may also include an enclosure 106 that can be used to remove fouling on and adjacent appendages of a vessel, such as anodes, transducer housings, suction grates and recesses.

The enclosure 106 includes a frame member 107, a pair of support hoops 108 at longitudinal ends of the enclosure 106, and a pair of end plates 109. The frame member 107, the support hoops 108 and the end plates 109 provide structural integrity for transparent top 110, side 111 and end walls 112. In this embodiment, the transparent walls are formed of Perspex material, although it will be understood that other suitable materials are envisaged.

The top wall 110 includes a top support bar 114 in which elongate top apertures 116 are formed, and attached inwardly of the enclosure over the top apertures is a sealing strip 118. The sealing strip 118 is formed of resilient material, such as rubber, and includes a longitudinal slit 120.

Similarly, the side and end walls 111, 112 also include side apertures 122 formed in side bars 125, end apertures 124, and associated sealing strips 126, 128 and longitudinal slits 131, 132.

The frame member 107 may also be provided with one or more sealing members, for example formed of rubber material, which assist in providing a good seal between the enclosure 106 and a vessel during use.

The purpose of the apertures 116, 122, 124 and sealing strips 118, 126, 128 is to enable a cleaning nozzle (not shown) to be disposed in the space defined by the enclosure 106 without overly compromising the relative negative pressure environment in the space.

The enclosure 106 also includes a pipe stub 130 in communication with the space inside the enclosure, the pipe stub 130 disposed on one of the side support bars 125 and facilitating connection to a suction hose of the cleaning system 106.

In this example, the frame member 107, the support hoops 108, the side plates 109 and the support bars 114, 125 are formed of aluminium material, although it will be understood that other suitable materials are envisaged.

During use, the enclosure 106 is disposed over an appendage that is desired to be cleaned and a suction hose (not shown) is attached to the pipe stub 130 so as to create a relative negative pressure environment inside the enclosure. A suitable high pressure cleaning nozzle is then inserted through one of the apertures 116, 122, 124 and used to clean fouling from at and around the appendage(s). Fouling material that is separated from the vessel is drawn out of the enclosure, and for example caused to move up to the separation device 18 through the extraction conduit 19.

It will be appreciated that the transparent walls 109, 110, 111 provide a user with good vision during a cleaning operation, and the configuration of the enclosure 106 allows regions of a vessel hull adjacent appendages to be cleaned whilst minimising egression of fouling material into the surrounding marine environment outside of the enclosure.

Modifications and variations as would be apparent to a skilled addressee are deemed to be within the scope of the present invention.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A cleaning head for cleaning a submerged surface, the cleaning head comprising:

a body portion;

a skirt portion extending around a periphery of the body portion, the skirt portion performing a sealing function between the body portion and a submerged surface desired to be cleaned when the cleaning head is disposed on the submerged surface during use;

at least one cleaning member for causing material on the submerged surface to separate from the submerged surface when the cleaning head is disposed on the submerged surface during use and the cleaning member moves relative to the submerged surface; and at least one suction aperture in fluid communication with a space defined between the body portion and the submerged surface during use;

wherein during use when the cleaning head is disposed on the submerged surface and the at least one suction aperture is connected in fluid communication with a device for generating a negative pressure, material separated from the submerged surface by the at least one cleaning member is drawn away from the cleaning head through the suction aperture;

wherein at least one cleaning member comprises at least one cleaning element arranged to generate a fluid current adjacent the submerged surface when the cleaning element moves relative to but substantially does not touch the submerged surface during use, the fluid current causing material to separate from the submerged surface.

2. The cleaning head according to claim 1, wherein the body portion comprises a plurality of body portion sections moveably connected together.

3. The cleaning head according to claim 1, wherein the skirt portion has a bristle-like configuration.

4. The cleaning head according to claim 1, comprising a height adjustment system arranged to facilitate adjustment of the distance between the body portion and the submerged surface to be cleaned, and thereby adjustment of the degree of compression of the skirt portion during use, and adjustment of the efficacy of the seal formed between the skirt portion and the submerged surface.

5. The cleaning head according to claim 1, comprising a drive mechanism arranged to urge the cleaning head to move relative to the submerged surface during use.

6. The cleaning head according to claim 5, comprising a height adjustment system arranged to facilitate adjustment of the distance between the body portion and the submerged surface to be cleaned, and thereby adjustment of the degree of compression of the skirt portion during use, and adjustment of the efficacy of the seal formed between the skirt portion and the submerged surface, wherein the height adjustment system is arranged to facilitate adjustment of the distance between one or more of the drive shafts and the body portion.

7. The cleaning head according to claim 1, comprising a plurality of cleaning members.

8. The cleaning head according to claim 1, wherein at least one cleaning element includes a foot portion disposed at a first side of the cleaning element facing towards the direction of movement of the cleaning element during use, and a cut out portion disposed at a second side of the cleaning element facing away from the direction of movement of the cleaning element during use.

9. The cleaning head according to claim 8, wherein the foot portion is substantially wedge shaped.

10. The cleaning head according to claim 9, wherein the wedge shape tapers at an angle of approximately 45°.

11. The cleaning head according to claim 8, wherein the shape of the cut out portion is substantially the same as the shape of the foot portion.

12. The cleaning head according to claim 8, wherein each cleaning element is arranged to rotate such that the cut out portion follows a rotational path defined by the foot portion.

13. The cleaning head according to claim 1, wherein the cleaning member comprises at least one rotatable disc portion, each disc portion including at least one cleaning element.

14. The cleaning head according to claim 1, wherein the cleaning head comprises at least one buoyancy member.

15. The cleaning head according to claim 1, comprising an impeller for reducing pressure at the cleaning head in a region between the cleaning head and a submerged surface during use.

16. The cleaning head according to claim 15, comprising a housing arranged to rotatably receive the impeller, the housing including a housing skirt portion arranged to perform a sealing function between the housing and the submerged surface desired to be cleaned when the cleaning head is disposed on the submerged surface during use.

17. The cleaning head according to claim 15, wherein the impeller comprises a hollow raised section having alternately circumferentially disposed wall portions and wall apertures, and at least one impeller blade extending outwardly of a respective wall portion, the hollow raised section defining an impeller aperture in fluid communication with the wall apertures, wherein rotation of the impeller causes a reduction in pressure in the hollow raised section.

18. The cleaning head according to claim 17, wherein the disc portion includes a central aperture and the hollow raised section is disposed adjacent and in fluid communication with the central aperture.

19. The cleaning head according to claim 18, wherein the impeller is resiliently connected to the cleaning member.

20. A method of cleaning a submerged surface, the method comprising:

providing a cleaning head having:

a body portion;

a skirt portion extending around a periphery of the body portion; and at least one cleaning member having at least one cleaning element for causing material on the submerged surface to separate from the submerged surface when the cleaning head is disposed on the submerged surface and the at least one cleaning element moves relative to the submerged surface;

disposing the cleaning head on the submerged surface such that the skirt portion contacts the submerged surface and performs a sealing function between the body portion and the submerged surface;

connecting a space defined between the body portion and the submerged surface in fluid communication with a device for generating a negative pressure; and activating said device and the at least one cleaning member so that material is separated from the submerged surface and is drawn away from the cleaning head;

wherein the at least one cleaning element is arranged to generate a fluid current adjacent the submerged surface when the cleaning element moves relative to but substantially does not touch the submerged surface during use, the fluid current causing material to separate from the submerged surface.

21. The method of claim 20, further comprising rotating each cleaning member using one or more hydraulic motors.

22. A cleaning head as claimed in claim 20, comprising providing at least one cleaning element with a foot portion disposed at a first side of the cleaning element facing towards the direction of movement of the cleaning element during use, and a cut out portion disposed at a second side of the cleaning element facing away from the direction of movement of the cleaning element during use.

* * * * *